US005758685A

United States Patent [19]

Tisbo et al.

[11] Patent Number: 5,758,685

[45] Date of Patent: Jun. 2, 1998

[54] INDUSTRIAL HOSE CART

[75] Inventors: Thomas A. Tisbo, Barrington Hills; Stephen P. Whitehead, Elgin; Brian Moon, Sycamore; Mark P. Slaven, Chicago; Michael G. Uffner, Naperville, all of Ill.

[73] Assignee: Suncast Corporation, Batavia, Ill.

[21] Appl. No.: 610,993

[22] Filed: Mar. 5, 1996

[51] Int. Cl.[6] ..... B65H 75/34

[52] U.S. Cl. ..... 137/355.27; 137/355.26; 137/580

[58] Field of Search ..... 137/355.26, 355.27, 137/355.16, 580

[56] References Cited

U.S. PATENT DOCUMENTS

| | | | |
|---|---|---|---|
| Re. 32,510 | 9/1987 | Tisbo et al. | 137/355.27 |
| 177,367 | 5/1876 | Bartlett . | |
| 238,153 | 2/1881 | Piper . | |
| D. 328,173 | 7/1992 | Nelson | D34/26 |
| D. 349,039 | 7/1994 | Goodman et al. | D8/359 |
| D. 352,149 | 11/1994 | Nelson et al. | D34/26 |
| D. 363,207 | 10/1995 | Tisbo et al. | D8/359 |
| 706,968 | 8/1902 | Mond . | |
| 904,380 | 11/1908 | Vader . | |
| 1,001,383 | 8/1911 | Geer et al. . | |
| 1,227,466 | 5/1917 | McDowell . | |
| 1,441,157 | 1/1923 | Krenke . | |
| 1,901,660 | 3/1933 | Lund . | |
| 1,914,654 | 6/1933 | Tomblom . | |
| 2,023,611 | 12/1935 | Neuman | 74/230.5 |
| 2,089,547 | 8/1937 | Folliot | 299/79 |
| 2,095,653 | 10/1937 | Tepel | 248/343 |
| 2,155,769 | 4/1939 | Porter | 242/90 |
| 2,283,626 | 5/1942 | Freydberg | 242/56 |
| 2,312,528 | 3/1943 | Davis | 299/78 |
| 2,512,756 | 6/1950 | Wasserman | 242/87 |
| 2,608,360 | 8/1952 | Cootware | 242/87 |
| 2,609,231 | 9/1952 | Crawford | 299/53 |
| 2,659,546 | 11/1953 | Rotter et al. . | |
| 2,755,035 | 7/1956 | Moulder | 242/87 |
| 2,918,975 | 12/1959 | Conery et al. | 169/24 |
| 3,050,078 | 8/1962 | Hooper | 137/355.19 |
| 3,051,189 | 8/1962 | Pro | 137/242 |
| 3,110,453 | 11/1963 | Becker et al. | 242/107.2 |
| 3,139,192 | 6/1964 | Maguire | 211/135 |
| 3,144,041 | 8/1964 | Werner et al. | 137/355.12 |
| 3,388,716 | 6/1968 | Wilson | 137/355.22 |
| 3,407,836 | 10/1968 | Keiser | 137/344 |
| 3,433,247 | 3/1969 | Haselden | 137/355.26 |
| 3,522,888 | 8/1970 | Grams et al. | 211/132 |
| 3,625,450 | 12/1971 | Lloyd | 242/86 |
| 3,977,429 | 8/1976 | Stevenson | 137/355.27 |
| 3,995,487 | 12/1976 | Locke | 74/230 |

(List continued on next page.)

FOREIGN PATENT DOCUMENTS

| | | | |
|---|---|---|---|
| 133490 | 7/1949 | Australia . | |
| 2415596 | 9/1979 | France . | |
| 1361417 | 7/1974 | United Kingdom | D02J 7/00 |
| 1378032 | 12/1974 | United Kingdom | B65H 75/46 |

OTHER PUBLICATIONS

A Tidy Way To Reel In Profits, Brochure, Ames, Corp., Parkersburg, WV 26102, 1995.

*Primary Examiner*—A. Michael Chambers
*Attorney, Agent, or Firm*—Thomas W. Tolpin

[57] ABSTRACT

A portable hose cart apparatus for windably holding a flexible hose and for transporting thereof. The cart includes a pair of vertical side frames shaped in the form of flanking arms each having a hub bearing surface. The frame provides a base structure for steel components that are secured by use of rotatable frame fasteners. The steel is encompassed by a seamless plastic sleeve that shrinks to the steel through a heating process. Distal ends of the steel are bound by use of a wedge shaped locking block which frictionally secures the steel tubes to forward and upper support members. A spool assembly is positioned between the frame sides forming a hose support surface therebetween, the frame sides having a shape to minimize plastic material yet maximize support when the cart is being transported.

21 Claims, 8 Drawing Sheets

U.S. PATENT DOCUMENTS

| | | | |
|---|---|---|---|
| 4,033,552 | 7/1977 | Kuzarov | 254/166 |
| 4,131,381 | 12/1978 | Alberts | 403/353 |
| 4,137,939 | 2/1979 | Chow | 137/355.16 |
| 4,224,960 | 9/1980 | Nederman | 137/355.23 |
| 4,272,037 | 6/1981 | Becker et al. | 242/118.1 |
| 4,315,522 | 2/1982 | Brown | 137/355.17 |
| 4,506,698 | 3/1985 | Garcia et al. | 137/355.26 |
| 4,512,361 | 4/1985 | Tisbo et al. | 137/355.27 |
| 4,537,215 | 8/1985 | Roman | 137/355.26 |
| 4,586,676 | 5/1986 | Johnston et al. | 137/355.26 |
| 4,700,737 | 10/1987 | Nelson | 137/355.27 |
| 4,768,546 | 9/1988 | Brusadin et al. | 137/355.17 |
| 4,777,976 | 10/1988 | Johnston et al. | 137/355.27 |
| 4,913,580 | 4/1990 | Whitehead | 403/326 |
| 4,974,627 | 12/1990 | Nelson | 137/355.27 |
| 5,007,598 | 4/1991 | Spear et al. | 137/355.27 |
| 5,046,520 | 9/1991 | Sanchez et al. | 137/355.27 |
| 5,056,553 | 10/1991 | Whitehead et al. | 137/355.27 |
| 5,425,391 | 6/1995 | Tisbo et al. | 137/355.27 |

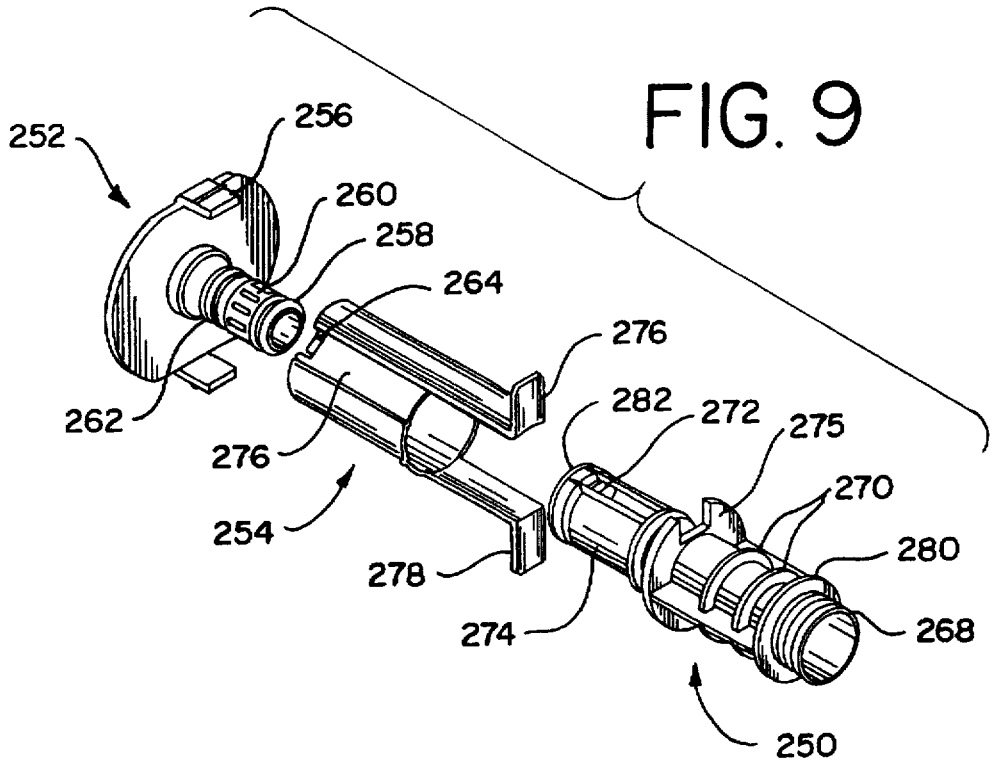
FIG. 9
FIG. 10
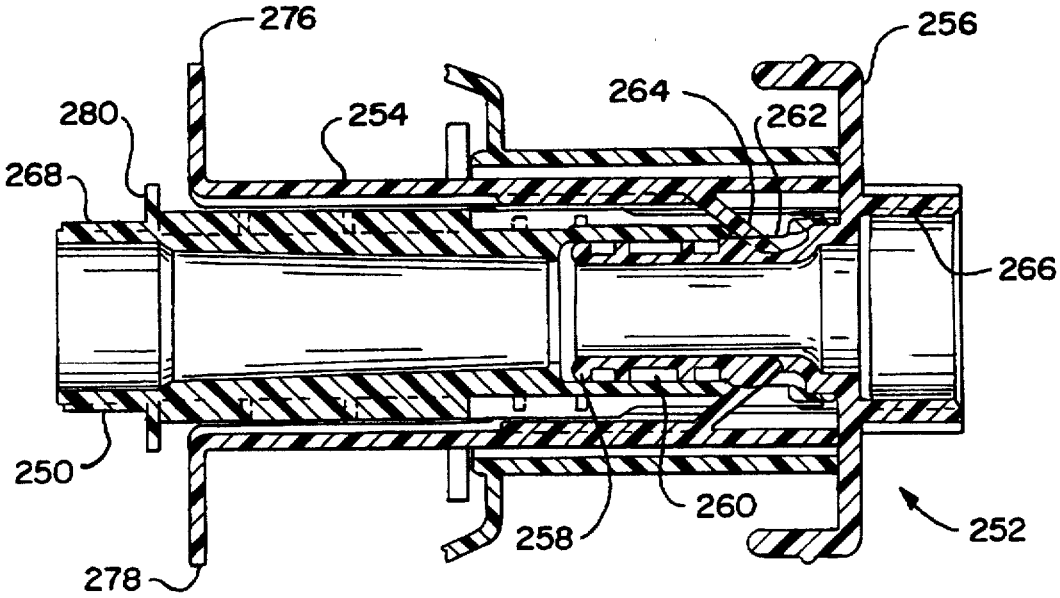

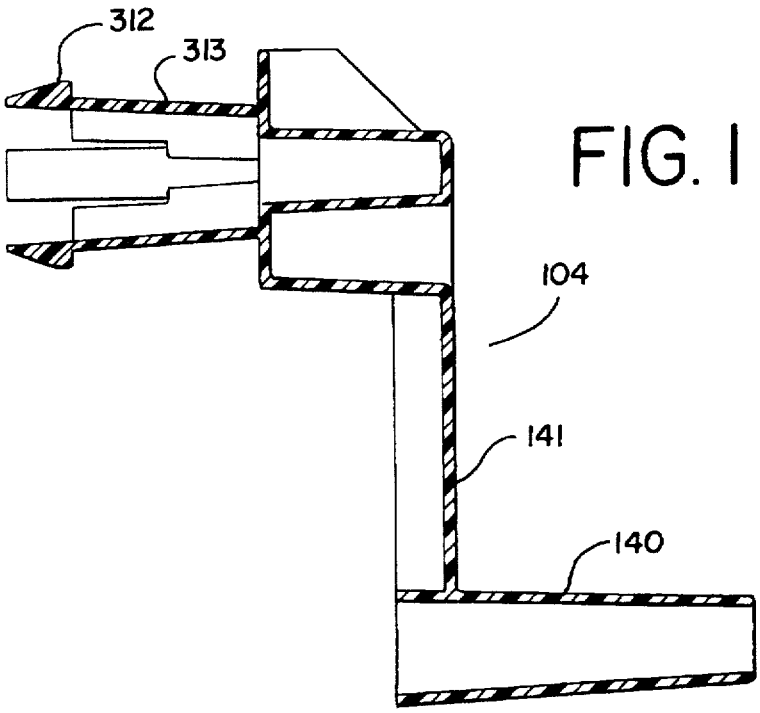
FIG. 11
FIG. 12
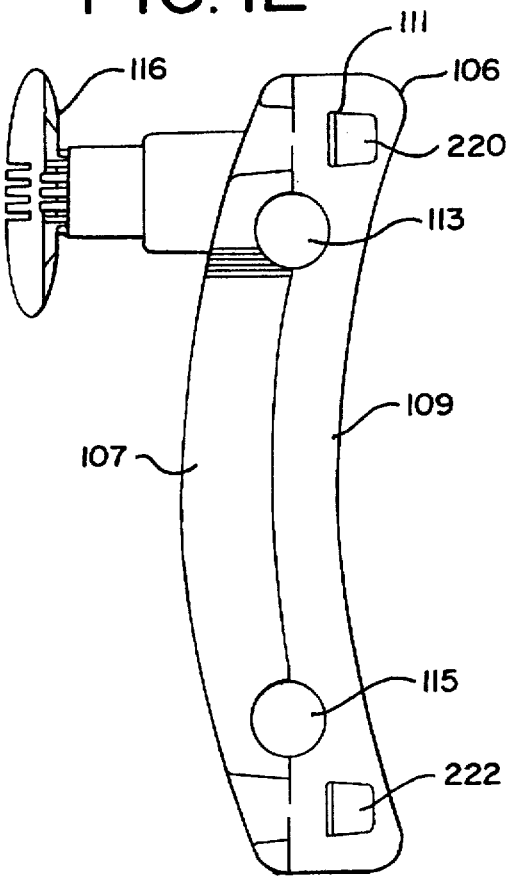
FIG. 13
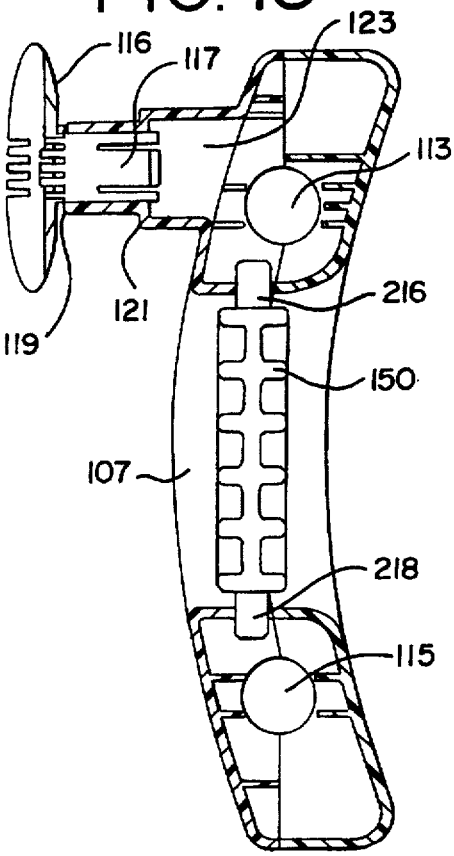

INDUSTRIAL HOSE CART

FIELD OF THE INVENTION

This invention relates to the storage of hoses and more particularly, to an industrial hose cart for the storage and transportation of a large length of heavy duty flexible hose.

BACKGROUND OF THE INVENTION

Portable hose carts are now commonplace items that have gained wide public acceptance for the purposes of conveniently handling flexible hoses such as those used in residential lawn watering. Hose carts are primarily constructed of molded plastic components and include a rotatable spool for taking up and paying out of the flexible hose. A typical frame used for support of a rotatable spool assembly consists of two A-shaped frames located on opposite sides of the spool assembly allowing for rotation of the spool therebetween. Tilting of the frame onto a pair of wheels allows the portable hose cart to be easily transported. Portable hose frames of current design are capable of accommodating most garden hoses found in a residential situation. In such a situation, a homeowner is careful in dispensing or retracting of the hose and unlikely to be utilizing a hose which adds a substantial amount of weight to the cart.

Suncast Corporation is considered a pioneer in the field of portable hose carts having been awarded numerous patents which enhance the manufacturing, reliability and convenience of portable hose carts. Some of the patents include U.S. Pat. Nos. 4,506,698; 4,512,361; 4,777,976; 4,586,676; 5,046,520; 5,056,553; 5,425,391; and U.S. Pat. No. Re. 32,510, the teachings of which are incorporated herein by reference.

A problem with the prior art is that an all plastic hose cart cannot accommodate heavy loads associated with long lengths of hose, heavy duty hoses, or situations in which the cart is used roughly. These situations may arise when the hose cart is used for commercial or industrial applications that include conditions beyond the designed capabilities. Use of a conventional cart in such a situation may lead to premature failure and consumer dissatisfaction. In this manner, a cart constructed of steel would provide the needed strength, yet lack the noncorrosive and lightweight properties that have made a residential cart so popular.

For example, a landscaper performing lawn maintenance tasks transport their own hoses to and from numerous job sites every day. Any hose support in this type of application is subjected to a tremendous amount of abuse. Simply placing a cart on a trailer results in the frame enduring the weight of the hose as it bounces during highway transportation. Movement of the hose cart may consist of rolling it off the trailer platform and allowing it to drop to the ground, again resulting in a higher amount of stress than the conventional hose cart is designed to endure.

This problem is further exacerbated by the tendency of commercial enterprises to utilize industrial equipment to provide longevity. For example, landscapers will typically utilize commercial lawnmowers to provide longevity. Similarly, the landscaper benefits from purchasing heavy duty hoses of longer lengths which, when placed upon the hose carts of the prior art, may stress the cart in and of itself.

The need for portable hose carts is not limited to landscapers. Long heavy hoses are used in cleaning airplanes, tractor trailers, boats, buildings, and so forth. Without a cart, the hose remains coiled on the ground until needed producing a hazard for individuals walking in the area, as well as creating an unsightly pile capable of quickly accumulating debris. Only an industrial hose cart can rectify this situation.

The use of a hose cart for industrial purposes requires a sturdy frame but consideration must be made for weight. The movement of a hose cart results in additional frame stress at the point of wheel mounting, while rotation of a hose results in spool stress. When a commercial grade hose is wrapped on the spool assembly, and the hose cart tilted onto the wheels, movement places the weight directly on the wheels and associated support structure. For example, in boatyards the surface of the yard is unfinished and movement of a hose cart across a gravel yard requires a frame capable of holding the hose under such conditions. In addition, if the hose is not emptied of water, the weight added to the terrain will quickly ruin the cart. Such a situation exists in baseball fields, airports, hospitals, and so forth. Even movement down steps or over curbs results in an extraordinary stress that prior art hose carts are not designed to repeatedly accommodate. In these situations plastic is not practical for all frame components, yet a hose cart made entirely of steel is not a proper alternative.

Thus, what is needed in the art is a portable hose cart capable of operating in an industrial environment having the strength of steel combined with the lightweight corrosion resistance properties of plastic.

SUMMARY OF THE INVENTION

The instant invention is a portable hose cart made from a combination of steel and plastic for windably holding a long or heavy duty flexible hose. The hose cart comprises a first frame side and a second frame side with each frame side constructed of plastic and characterized as a flanking arm having a base with a frontal projecting wall forming a curvature shape. Each frame side has an inner and an outer side surface with a horizontal bottom wall positioned along the ground surface, a vertical back wall formed perpendicular to the bottom wall, a frontal wall with a curvature formed therebetween forming a lower side wall which is disposed between the bottom wall and the frontal wall and a curvature upper side wall disposed between the vertical back wall and the frontal wall. A hub bearing surface is centrally disposed between the upper and lower side wall at a distance from the frontal wall providing room for placement of a spool assembly therebetween.

The frame sides are supported by a forward frame support secured by use of horizontally disposed steel tubes which extend forward from each frame side. A second set of tubes are angularly disposed passing through each frame side juxtapositioned to the frontal wall, the tubes are secured to the frame support member by a wedge shaped attachment device that is drawn into the support by a threaded bolt.

Similarly, an upper frame support member is located above each of the frame sides, secured by use of steel tubes leading from and forming a continuation of the angularly disposed steel tubes from the forward frame support member, and vertical steel tubes extending from the frame side back wall. Each of the tubes are secured in place by a wedge shaped attachment device that is drawn into the support by a threaded bolt. The upper frame support includes an integrated plastic handle and provisions for mounting of a plastic tray container. The steel tubes are encompassed in a polyethylene sleeve that adheres to the outside of the steel tubes upon the retraction of heat during the manufacturing process, the sleeve eliminates the need for painting or prepping of the steel tubes, yet provides a nearly impervious surface covering having the corrosion inhibiting ability of plastic.

A spool assembly is positioned between each of the frame sides and comprises of opposing reels each having a centrally disposed hub which is rotatably coupled to each frame's hub and spaced apart by reel flanges, all of which define a support surface for the winding of a flexible hose. A hand crank is inserted through one of the hubs providing a direct coupling to the spool assembly allowing for manual rotation thereof.

A hose connector is releasably insertable through one of the hubs providing an inlet connection which fluidly communicates an inlet adaptor, on an outer side surface of the frame side, to an outlet adaptor positioned on an inner side surface of the frame side. The hose connector allows for the rotation of the spool assembly while coupled to a water source to allow water passage. A pair of wheels are joined to the frame sides so as to allow tilting of the frame onto the wheels for transporting.

A hose guide is provided along the frontal wall of the frame side. The hose guide includes a window for passage of hose with the hose guide being freely moveable along a horizontal path provided by hose guide supports. A hose can be wound onto the spool in layers with adjacent turns and each layer being contiguous. Operating of the crank for rotation of the spool and moving the hose guide along the horizontal path provided by the hose guides allows the operator to wind the hose without touching it.

Thus, an objective of the instant invention is to provide a heavy duty hose cart having a frame constructed of plastic and steel wherein the steel is positioned in areas of high stress concentration.

Yet another objective of the instant invention is to teach steel to plastic abutment by use of a wedge shaped engagement and threaded frame fasteners to securely position the tubes in position.

Yet another objective of the instant invention is to disclose a modular frame that may be readily assembled with minimal hand tools.

Still another objective of the instant invention is to disclose a spool assembly that includes a reel flange that is maintained in a spaced apart position by use of internally positioned reel spacers.

Yet still another objective of the instant invention is to teach the use of a functional support frame having a shape which places the weight of the spool assembly directly over the wheels for transportation and further minimizes the amount of plastic material used in construction.

Still another objective of the instant invention is to incorporate a hose guide having functional support posts to stabilize the distal ends of the frame in a spaced apart position.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 9 is an enlarged exploded view of the hub hose connector;

FIG. 10 is a cross-sectional side view of FIG. 9 in an assembled position;

FIG. 11 is an enlarged side view of the reel crank;

FIG. 12 is a side view of the hose guide; and

FIG. 13 is an cross sectional side view of FIG. 12.

DETAILED DESCRIPTION OF THE PREFERRED EMBODIMENT

Figure 1:
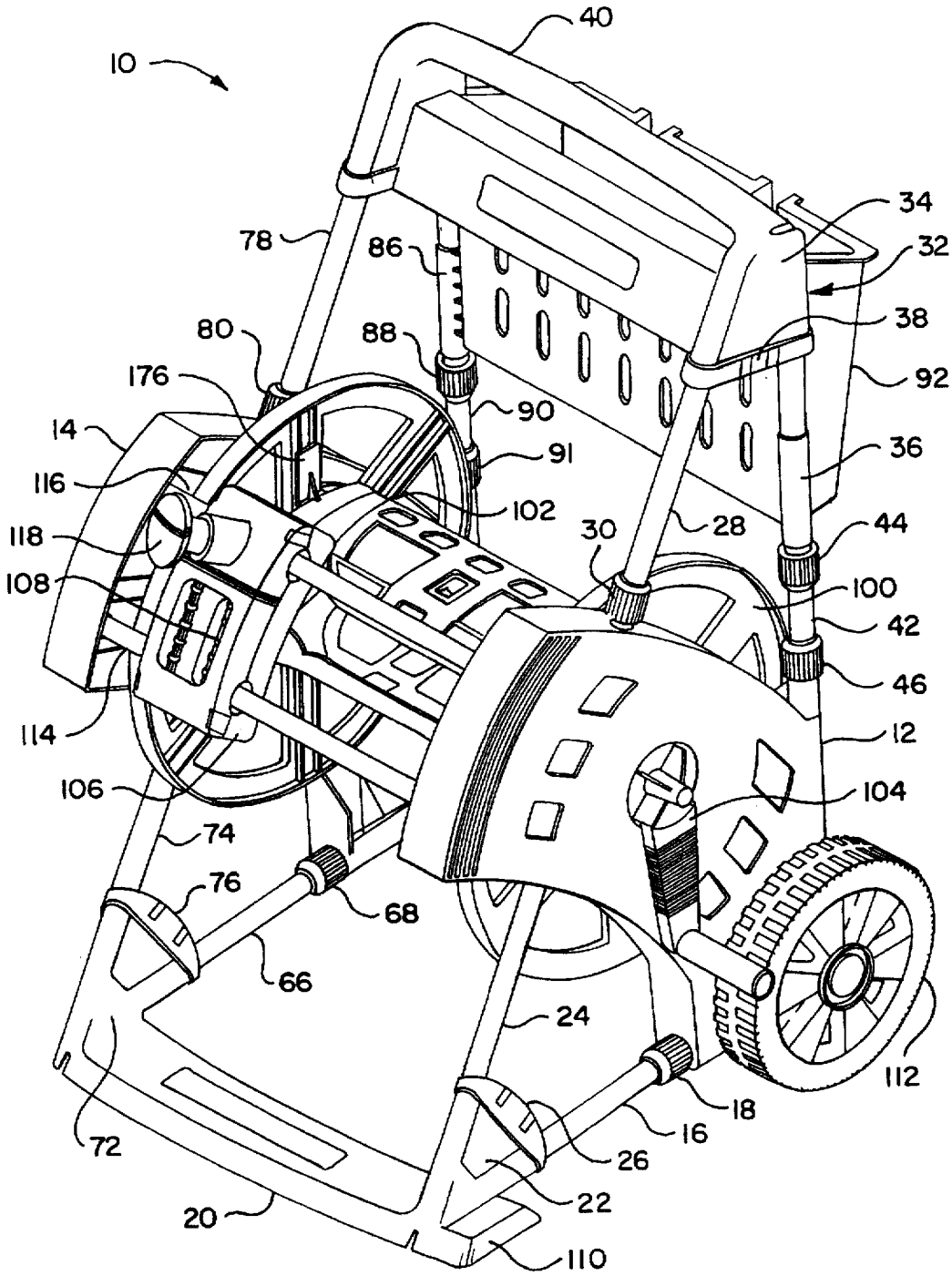
FIG. 1 is a perspective view of the industrial hose cart of the instant invention.

Referring to FIG. 1, shown is the portable hose cart 10 embodying the various features of the instant invention. The hose cart a storage apparatus for a flexible hose allowing ease of transport. The cart further operates as a base station coupling to a water outlet wherein an operator may remove as much hose as necessary while one end of the hose remains fluidly coupled to the water supply. The hose cart 10 basically comprises of frame sides 12 and 14 which support spool assembly 100 therebetween with a front support 20, combination upper support 34 with handle 40 for transporting on wheels 112. Specifically referring to frame side 12, a horizontally disposed support member 16 extends outwardly which is encompassed with a seamless polyethylene plastic sleeve. A distal end of the member 16 is coupled to forward support member 20 along coupling section 22 which forms a receptacle and further allows for the coupling of angular support member 24. As will be described later in this description, a wedge shaped bracket 26 is drawn into an open end of coupling section 22 thereby securing each tubular support member in a fixed position.

Support member 28 (FIG. 1) provides an extension to angular support member 24 by use of fastener 30 at one end with a coupling to upper support member 32 at the opposite end. Upper support member 32 includes a coupling section 34 similar to coupling section 22 of the forward support member 20. A wedge shaped bracket 38 is also used for securing the supports 28 and 36 in a fixed position in relation to upper support member 32. Vertically disposed support member 36 is an extension to vertical support 42 and coupled thereto by tube fastener 44 which in turn is secured to frame side 12 by frame fastener 46. Handle 40 is integrated into the upper support member 32 providing operator convenience in movement of the cart.

The opposing frame side 14 (FIG. 1) forms a mirror image of frame side 12 and includes a base for positioning of horizontally disposed support member 66 for securement to frame side 14 by frame fastener 68. Support member 66 is secured to the forward support member 20 at support section 72 completing an opposing stance with support member 16; forward support member further couples to angular member 74. A wedge shaped bracket 76 is then used to secure both support members 66 and 74 in a fixed position. Tubular support member 78 couples to support member 74 by fastener 80 along a proximal end with a distal end inserted into upper support member 32. Vertically disposed support member 86 is directed downwardly from the upper support member 32 and is coupled by fastener 88 to a second vertical support member 90, frame fastener 91 provides attachment to frame side 14. The upper support member 32 operates in conjunction with the vertically disposed support members 36 and 86 providing a framing support for storage box 92. The forward support member 20 and the upper support member 32 form an A-frame structure for support of the spool assembly. The reel assembly is rotated by crank 104.

Cranking of the spool assembly in concert with reciprocating a hose guide 106 (FIG. 1) allows the user to be able to neatly wind a hose with adjacent turns in each layer. In this manner, the winding of the hose can be accomplished without the operator touching the hose. The frame sides 12 and 14, spool assembly 100, and forward and upward support members 20 and 34 are constructed of molded thermoplastic which allows long service life in outdoor use. The extensions from the frame sides which form support members are constructed of steel tubing encompassed by a polyethylene plastic sleeve, thereby providing a lightweight non-corroding structure. The forward support member 20 includes a substantially flat middle portion and adjoining tab 110 which allows the operator to place their foot so as to stabilize the cart during hose retraction. Once a hose is secured to the reel, the operator then may grasp the handle 40 and rotate the frame onto the wheels 112 for transportation.

Figure 2:
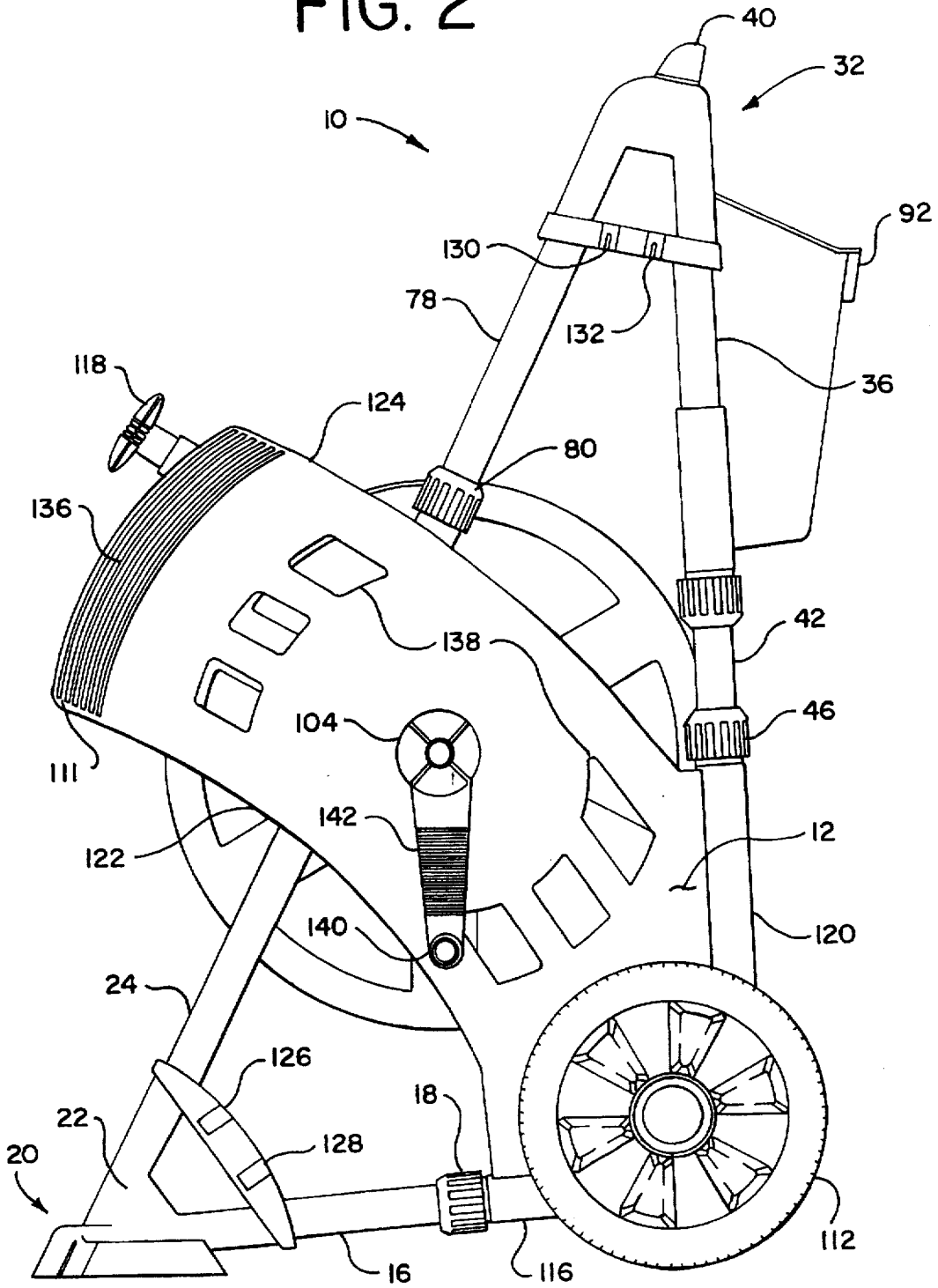
FIG. 2 is a right side plane view.

Now referring to FIG. 2, a side view of the hose cart 10 further illustrates frame side 12 with wheel 112 positioned adjacent the horizontal bottom wall and said vertical back wall. The frame has a chamber 116 which accepts the tubular support member 16 and secured thereto by frame fastener 18. Tightening of the frame fastener 18 clamps the support member 16 in a fixed position by means of a tightening crimp. Similarly, a vertical chamber is molded into the frame side 12 along portion 120 which allows the second vertical tubular support member 42 to be slidably inserted and secured thereto by frame fastener 46. The frame fastener 46 is also used to securely tighten the support member in a fixed position in relation to frame side 12. The lower angular tubular support member 24 extends through frame side 12 by use of an aperture located along a lower wall 122 and upper wall 124, fastener 80 allowing formation of an extension rod. As illustrated, forward support member 20 is shown receiving member 16 and 24 along triangular coupling section 22 which allows insertion of the wedge shaped bracket therebetween to secure the support members in a fixed position against an inner side surface of the coupling section 22.

The wedge shaped bracket, described in detail later in this specification includes tabs, shown by hidden lines, for engagement of slots 126 and 128 (FIG. 2) for centering of the wedge. The wedge is tightened in position by use of a bolt and nut assembly, not shown. As with the forward support member, the upper support member 32 includes slots 130 and 132 also shown by hidden lines for receipt of a wedge. Raised ribbing 136 along the distal end 111 of frame side 12 provides a decorative concealment design along the molding interface for guide supports 114 and 116, shown in FIG. 1, used to support the hose guide.

Figure 3:
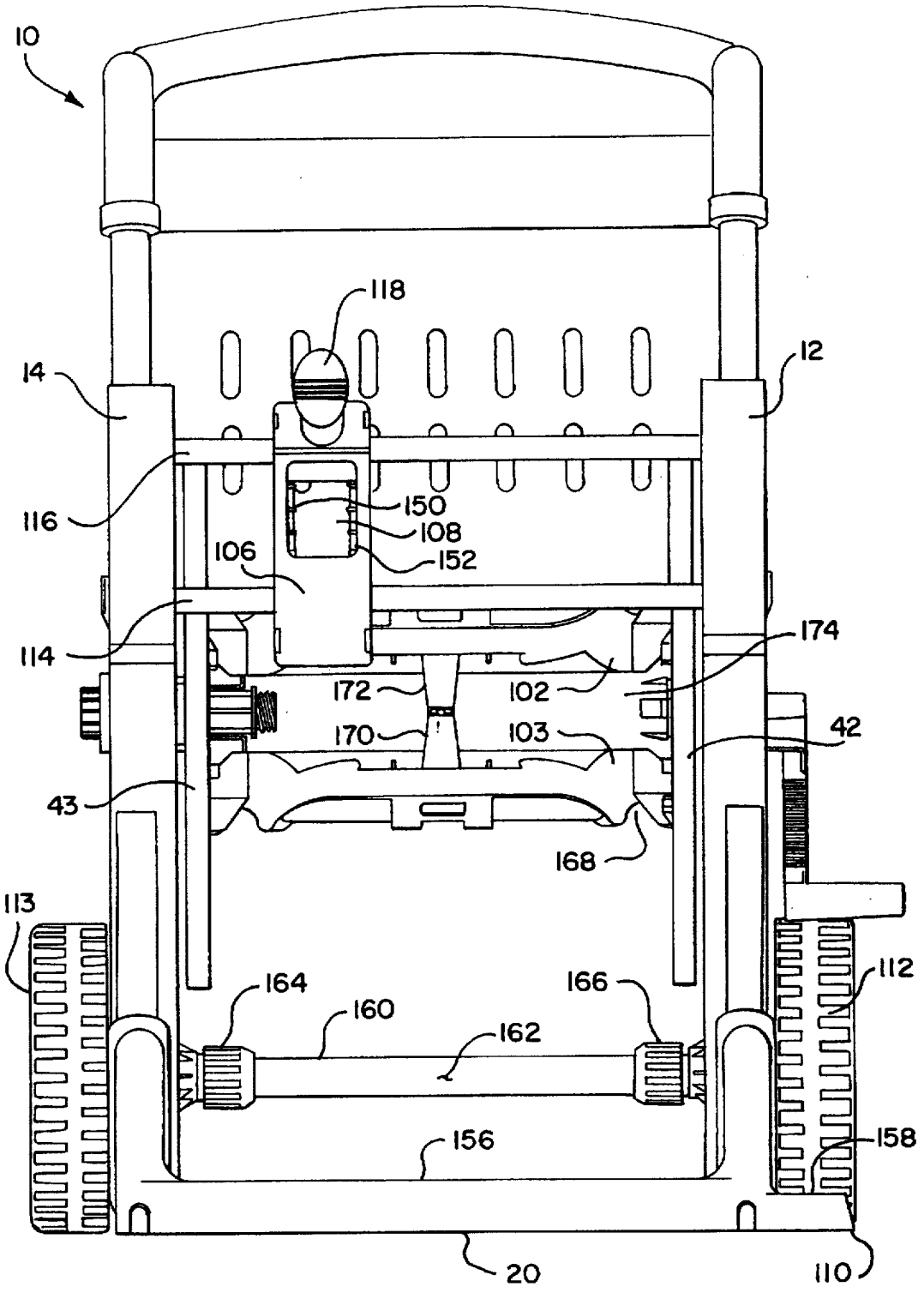
FIG. 3 is a front plane view.

Referring to FIG. 3, a front view of the hose cart 10 is illustrated having hose guide 106 slid across hose guide supports 114 and 116 adjacent to an inner side surface of frame side 12. The hose guide 106 is constructed of plastic using a grasping knob 118 connected to the guide by a mounting stem, not shown. The hose guide includes axial pins for rotation of vertically disposed rollers 150 and 152 located along the sides of the window 108. The vertical rollers 150 and 152 facilitate passage of a garden hose through the hose guide and are particularly useful when the hose passes through the guide at a sharp angle.

The base of frame sides 12 and 14 (FIG. 3) include an axle bearing support member 160 which further stabilize the frame sides in a spaced apart position. A tubular horizontally disposed support steel tube member 162 includes a plastic sleeve placed over the tube which is inserted into each side frame by using fasteners 164 and 166 for forming a secure connection. The frame fasteners coupling the support member 162 by a crimping action by rotational tightening of the fastener. As the support member 162 is hollow, wheels 112 and 113 are coupled together by a common axle placed through the hollow tubular support member 160.

A spool assembly is formed from a combination of reels and reel flanges. The reels 42 and 43 (FIG. 3) have a circular shape and are rotatably coupled to their respective frame side members 12 and 14 by a crank or a quick connect water coupling to be described later in this specification. The reels 42 and 43 provide support for the reel flanges 102 and 103 which are two identically molded cross braces each having an enlarged width as compared to the conventional hose carts with a hose cavity 168 extending across the outer circumference of each reel flange incorporating a taper to provide directional placement of a hose. The reel flanges include a molded spacer bracket 170 and 172 operatively associated with each other so as to maintain their respective reel flanges from collapsing when wound with a heavy hose. A cavity 174 formed between each reel flange allows an operator to reach therebetween in order to thread the female hose end of a hose to the male outlet of the hose connector. It should be noted that reel flanges 102 and 103 include the aforementioned cavities placed along each side edge allowing single piece part manufacture and further allowing a hose to be wrapped in either a clockwise or counterclockwise motion. The winding of the hose can be made from left to right or reversed based upon consumer preference in movement of the crank in relation to the preferred hub location. When the reel flanges 102 and 103 are coupled to the spaced apart reels 42 and 43, they form a spool assembly incorporating each component into position.

Figure 4:
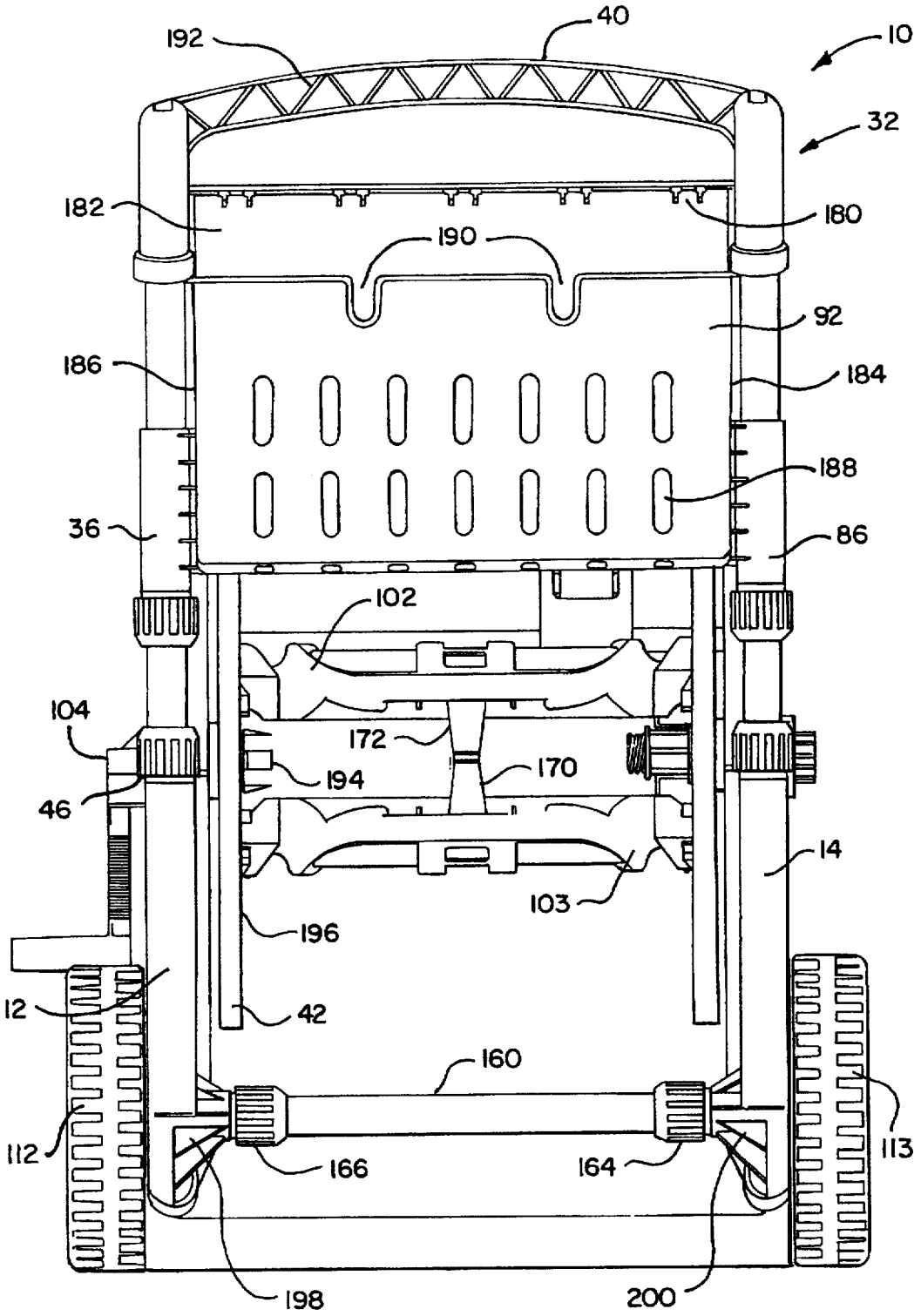
FIG. 4 is a rear plane view.

FIG. 4 is a back plane view of hose cart 10 illustrating storage box 92 coupled to the upper support member 32 along attachment points 180 and along each side edge 184 and 186 of the tubular support members 36 and 86. The storage box comprises a front and rear panel with through-holes 188 for drainage. Slotted apertures 190 are located along the upper edge of the rear panel for use in holding the bitter end of a hose. Side walls and a bottom wall provide a storage area for placement of items therein. Handle 40 is molded into the upper support member and utilizes reinforcement ribs 192 which provide rigidity to the handle with a minimal amount of plastic material.

Crank 104 (FIG 4) is illustrated with the expansion tabs 194 located on the inner surface 196 of reel 42. The tabs allow for a quick insertion and positive coupling of the crank to the frame side. The tabs further allow for ease of removal by compressing the tabs 194 to permit retraction of the crank 104. Each frame side has a plurality of ribs 198 and 200 which extend outward to reinforce the frame fastener 166 position for integration of the axle. Frame fastener 46 is rotatably coupled to the frame permitting the axle and support member to pass therethrough yet allow for the secure attachment to each frame side.

Figure 5:
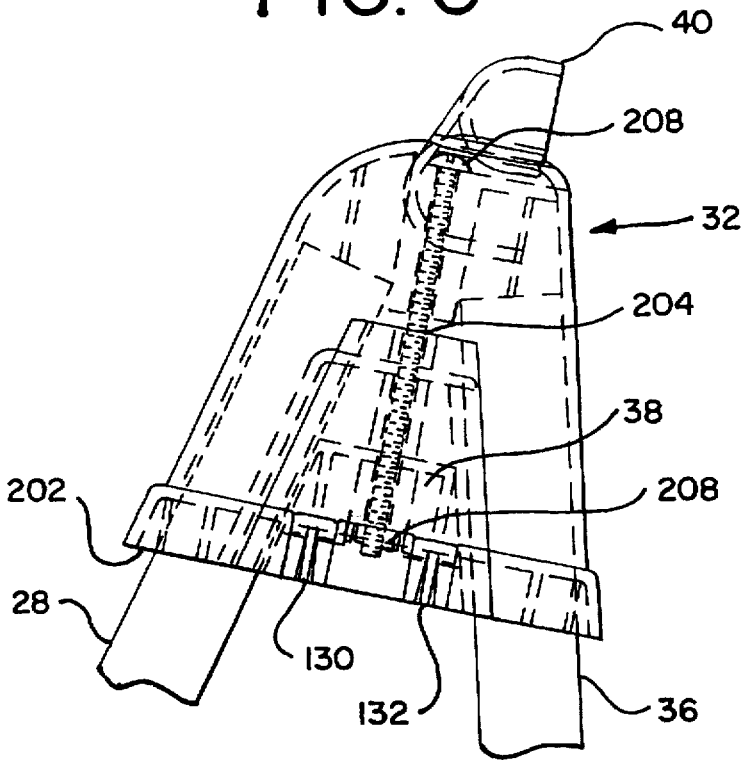
FIG. 5 is a cross-sectional side view of the upper support member.

FIG. 5 illustrates the upper support 32, shown in phantom, wherein the vertically disposed tubular support member 36 and upper angularly disposed tubular support member 28 are inserted into the upper support 32 with the wedge bracket 38 inserted from bottom edge 202 where it frictionally engages the side wall of each tubular support member. The wedge 38 is engaged by use of a threaded machine screw 204 having a lock nut 206 located at one end and a slotted engagement end 208 at the opposite end. Rotational movement of the machine screw causes the engagement of the locking nut 206 and results in the upward movement of the wedge bracket 38 forcing the tubular support members in a secure and fixed position. Slots 130 and 132 are formed through the side wall of the upper support member maintaining the wedge block in a predefined position. It is noted that support members 86 and 78 are held to the upper support member 32 in a similar manner but are not shown as it is duplicative of the above.

Figure 6:
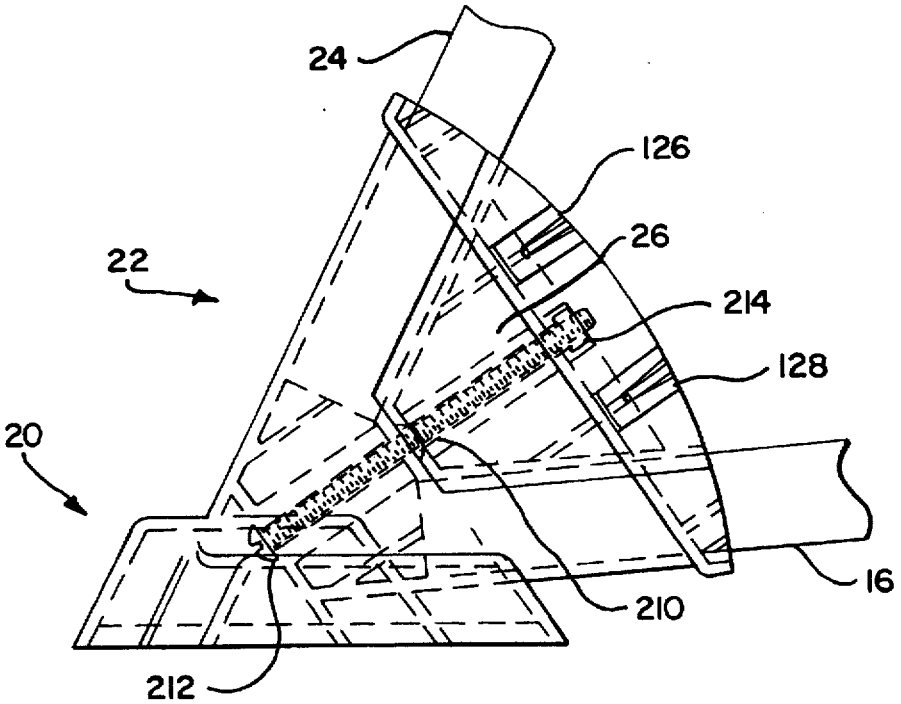
FIG. 6 is a cross-sectional side view of the forward support member.

FIG. 6 sets forth the forward support member 20 having the horizontally disposed tubular support member 16 and lower angular tubular support member 24 held securely in position by wedge shape bracket 26. The bracket 26 is positioned by slots 126 and 128 and will maintain frictional engagement by use of machine screw 210 having a slotted head 212 and locking nut 214. In a similar manner to the upper support member, the forward support member engages the tubular support members upon rotation of the machine screw 210 causing the tightening of lock nut 214 and the contraction of the wedge block toward the slotted head 212 thereby causing the frictional engagement to each tubular support member 16 and 24 both along a portion of the inner circumference in relation to the wedge block and the outer circumference in relation to the support section 22.

Figure 7:
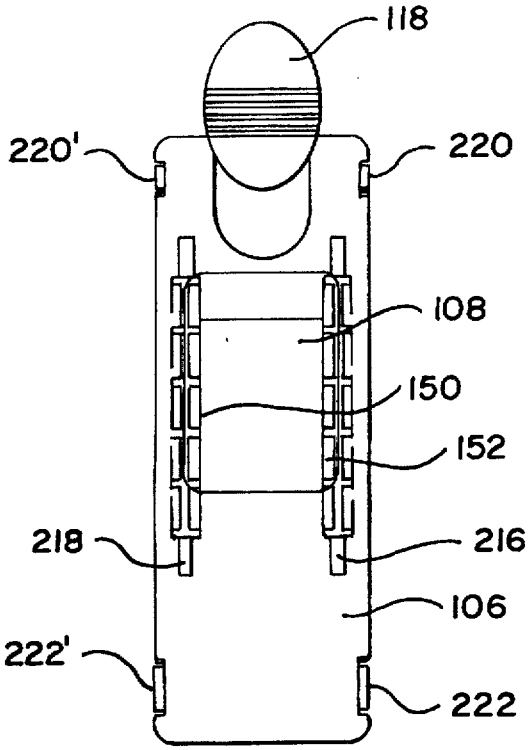
FIG. 7 is a front view of the hose guide.

Now referring to FIG. 7, the hose guide 106 includes a window 108 having vertically disposed rollers 150 and 152 which are shown partially extending into the opening. Recesses within the housing rotatably receive the axle pins 216 and 218 of each vertically disposed roller. The rollers facilitating passage of a garden hose through the guide and when used in conjunction with the hose guide handle 118. An operator may easily maneuver a hose while rotating the crank and spool assembly without soiling the operator's hands. The hose guide is constructed of a two piece plastic structure utilizing engagement tabs 220 and 222 for coupling to the adjoining bracket by sandwiching the hose guide support rods therebetween. An aperture, not shown, is partially formed by the coupling and receiving portions of the hose guide structure providing clearance for the hose guide rods to slide along the length thereof with minimal frictional interference.

Figure 8:
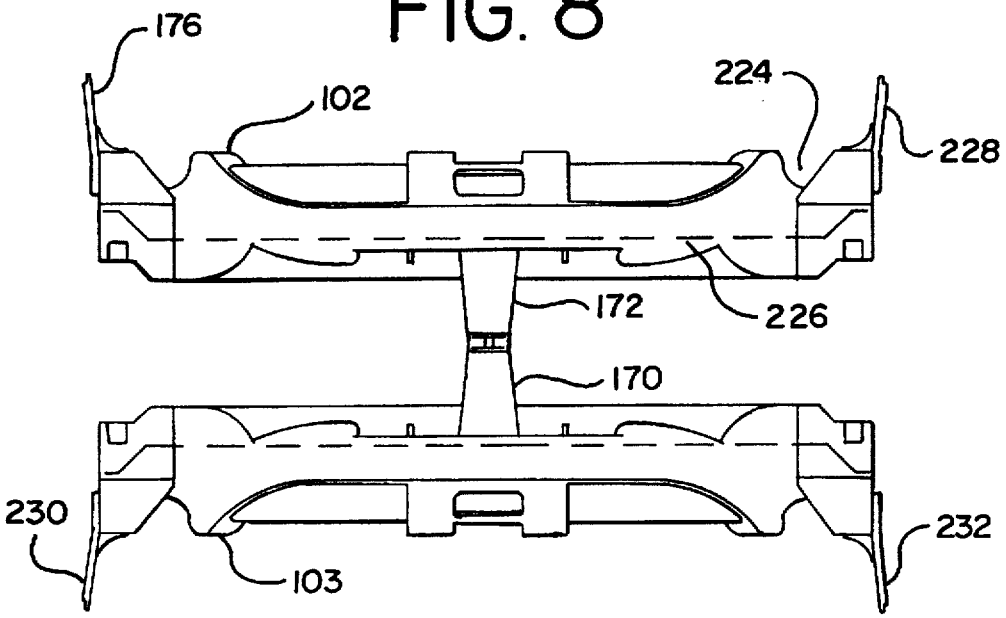
FIG. 8 is a front plane view of the hose flanges.

Referring to FIG. 8, the reel flanges 102 and 103 are made of two molded cross braces of mirror image. Each brace has a preformed hose chamber 224 extending from a first edge 226 with an inward slope providing a continuous chamber across the surface. The flanges taper so as to eliminate hose kinks which allows a directional placement of the hose during the winding process. It is noted that each section of the reel flange forms a mirror image allowing a hose to be rolled in a clockwise or counterclockwise rotation. The shape allows the hose to start from either the left side or the right side of the reel. Engagement tabs 176, 228, 230, and 232 allow for coupling of the reel flanges to their respective reels causing a locking engagement of the reels for support therefrom with the center of the reel half supported by reel flange bracket 170 and 172. It is noted that reel flanges 102 and 103 are constructed from a single piece of thermoplastic providing unitary structural integrity.

Referring to FIGS. 9 and 10, a hose connector is composed of a hose male coupler 250, a hose female coupler 252, and a syringe type coupling sleeve 254 for releasably coupling the hose male coupler 250 to the female adapter 252. Water from a conventional hose outlet is delivered to the hose female adapter 252 which is secured to the hub of a reel flange to prevent rotation by alignment tabs 256. The hose female adapter 252 includes a molded outlet tube 258 having a plurality of O-rings 260 for engagement with the interior of the hose male connector 250 to form a seal between the coupler 250 and the adapter 252. Groove 262 is provided for insertion of a plurality of locking tabs 264. The end of the adapter has internal hose threads formed therein for attachment to the male end of the hose. End 268, having external hose threads formed thereon, attach to the female end of the flexible hose to be wound around the reel flanges. The hose male coupler 250 is formed of a tubular pipe with reinforcement ribs 270 and an elongated slot 272 located on a lower portion 274 of the coupler insertable through release sleeve 254 formed from a tubular body 276 with the aforementioned locking tabs 264. The sleeve 254 includes finger pulls 276 and 278 which allow the unit to be used as a syringe type coupling. The adapter 252 fits within the coupler 250 so that the seals 260 frictionally engage the inner surface of the coupler 250 forming a water tight seal between the inlet 266 (FIG. 10) and the outlet 268. The sleeve 254 locks the coupler 250 to the adapter 252 by the insertion of the tabs 264 into groove 262. In operation, the pressing of the coupler 250 into the adapter 252 engages the lock tabs 264 through the hub of the flanges. To release the coupling, finger tabs 276 and 278 are pulled toward the coupling collar 280 wherein the leading edge 282 of the coupler 250 biases the locking tab 264 into a raised position so as to disengage the lock from the groove 262 allowing disassembly of the connection. Thus, lubrication or replacement of the O-rings is readily accessible by pulling the tabs 276 and 278 in a syringe type movement. Upon maintenance of the O-rings, the adapter and coupler can be easily reinstalled wherein a snap type action allows for physical and audible acknowledgement of engagement.

Referring to FIG. 11, the crank 104 is illustrated having a rigid handle 140 placed perpendicular to the handle extension 141. The crank 104 is coupled to the hub by use of independent locking tabs 312 which are biased outwardly for engagement of slots located along the centrally disposed aperture of the reel allowing installation without the need for hand tools. The crank body 104 is constructed from a single piece of thermoplastic with locking tabs 312 having a keyhole shape for insertion into the hub, the keyhole shape engaging a side edge of the hub allowing for the rotation thereof. It should be noted that the crank can also be removed without tools by forcing each of the locking tabs inwardly while the crank is withdrawn from a hub.

FIGS. 12 and 13 sets forth a side view of the hose guide 106 having the vertically disposed roller 150 depicted which is formed from a single piece of plastic including axle pins 216 and 218 extending outwardly therefrom. The roller is held in position by coupling the front cover 107 to rear cover 109. The front cover employs tabs 220 and 222 at each corner which are insertable through slot 111, also located at each corner of the rear cover 109. The tabs are biased outward to engage the slot allowing for assembly without tools. Apertures 113 and 115 are formed upon coupling the front and rear cover together and are used to encompass the hose guide support rails. The hose guide structure providing clearance for the hose guide rods to slide along the length thereof with minimal frictional interference. The handle 116 is rotatably coupled to the front cover 107 by expansion tabs 117 insertable through the end 119 past locking edge 121 allowing for the expansion of the tabs into cavity 123. The tabs allow for the rotation of the handle allowing an operator to easily maneuver a hose while rotating the crank and spool assembly without soiling the operator's hands.

It is to be understood that while we have illustrated and described certain forms of our invention, it is not to be limited to the specific forms and arrangement of parts herein described and shown. It will be apparent to those skilled in the art that various changes may be made without departing from the scope of the invention and the invention is not to be considered limited to what is shown in the drawings and described in the specification.

What is claimed is:

1. A hose cart, comprising:

first and second frames providing sides:

a spool assembly located between said sides for winding a hose;

a crank for rotating said spool assembly;

wheels for moving said frames; and tubular support members connected to and supporting said frames; and each of said tubular support members comprising a metal tube and a plastic sleeve encompassing said metal tube with said metal tube being positioned in said plastic sleeve.

2. A hose cart according to claim 1 wherein:

said tubular support members comprise angular support members, vertical support members, and horizontal support members; and said hose cart includes a forward support member positioned forwardly of said wheels, said forward support member being coupled to said angular support members and said horizontal support members; and an upper support member providing a handle positioned above said spool assembly, said upper support member being coupled to said vertical support members and support members providing an extension of said angular support members.

3. A hose cart according to claim 2 including:

a storage box positioned in proximity to said upper support member;

a hose guide located between said sides and operatively associated with and positioned forwardly of said spool assembly; and a hose connector positioned in proximity to one of said sides.

4. A hose cart according to claim 1 wherein said tubular support members include a tubular support member extending between said wheels, and said wheels are coupled by an axle positioned within and extending through said tubular support member.

5. A hose cart according to claim 1 wherein:

said metal tube comprises a steel tube; and said plastic sleeve comprises a polyethylene sleeve positioned about said steel tube.

6. A portable hose cart for windably holding an elongated flexible hose, comprising:

first frame and second frames, each frame characterized as a flanking arm having a hub bearing surface;

a forward frame support member for support of each said frame in an upright position comprising a plurality of tubular support members extending from each said frame and secured to each said frame;

an upper frame support member comprising a plurality of tubular support members extending upwardly from each said frame and secured to each said frame;

a spool assembly located between said first and second frames, said spool assembly defining a support surface for the winding of a hose;

a crank releasably insertable through one of said hub bearing surfaces providing a direct coupling to said spool assembly for manual rotation thereof, a hose connector releasably insertable through one of said hub bearing surfaces, said hose connector comprising an inlet adapter and an outlet adapter; and a pair of wheels axially journaled to said first and second frames; and said tubular support members of said forward frame support member and said tubular support members of said upper frame support member each comprising a metal tube positioned in a plastic sleeve.

7. The portable hose cart for windably holding an elongated flexible hose according to claim 6 wherein said first and second frames are constructed of thermoplastic and are further defined by an inner and an outer side surface, a horizontal bottom wall, a vertical back wall, a frontal wall, a lower side wall disposed between said bottom wall and said frontal wall, and an upper side wall disposed between said vertical back wall and said frontal wall.

8. The portable hose cart for windably holding an elongated flexible hose according to claim 7 wherein said hub bearing surface is centrally disposed between said upper and lower side wall at a distance from said frontal wall.

9. The portable hose cart for windably holding an elongated flexible hose according to claim 6 wherein said forward frame support member includes a first wedge-shaped bracket for wedging a first horizontally disposed tubular support member and a first lower angular disposed support member operatively associated with said first frame and a second wedge-shaped bracket for wedging a second horizontally disposed tubular support member and a second lower angular disposed support member operatively associated with said second frame.

10. The portable hose cart for windably holding an elongated flexible hose according to claim 6 wherein said metal tube comprises a steel tube.

11. The portable hose cart for windably holding an elongated flexible hose according to claim 6 wherein said plastic sleeve comprises a polyethylene sleeve.

12. The portable hose cart for windably holding an elongated flexible hose according to claim 6 including a hose guide and guide support spaced from said spool, said hose guide having a window for passage of a hose through said window said hose guide being movable along a path provided by said hose guide support whereby a hose can be wound on said spool assembly in layers by rotating said crank for rotation of said spool assembly.

13. The portable hose cart for windably holding an elongated flexible hose according to claim 12 wherein said hose guide includes rollers disposed on each side of said window providing ease of hose passage.

14. The portable hose cart for windably holding an elongated flexible hose according to claim 6 wherein said spool assembly comprises first and second reels each having a centrally disposed hub rotatably coupled to said hub bearing surface of said first and second frame, and said spool assembly further comprises reel flanges positioned between said reels and defining a support surface for the winding of a hose.

15. The portable hose cart for windably holding an elongated flexible hose according to claim 6 including a storage box having an open end, said storage box secured to said upper frame support member.

16. A portable hose cart for windably holding an elongated flexible hose comprising:

a first frame side and a second frame side, each frame side characterized as a flanking arm formed from a single piece of thermoplastic having an inner and an outer side surface, a horizontal bottom wall, a vertical back wall, a frontal wall, a lower side wall disposed between said bottom wall and said frontal wall, and an upper side wall disposed between said vertical back wall and said frontal wall, each said frame side having a hub bearing surface centrally disposed between said upper and lower side wall at a distance from said frontal wall;

a forward frame support member positioned beneath each said frame side by means of first horizontally disposed tubular support member and first lower angular disposed support member operatively associated with said first frame side and a second horizontally disposed tubular support member and second lower angular disposed support member operatively associated with said second frame side;

an upper frame support member positioned above each said frame side by means of first vertically disposed tubular support member and first upper angular disposed support member operatively associated with said first frame side and a second vertically disposed tubular support member and second upper angular disposed support member operatively associated with said second frame side, said upper frame support having an integrated handle;

a spool assembly located between said frame sides said spool comprising a first and second reel each having a centrally disposed hub rotatably coupled to each said frame side hub bearing surface and spaced apart by opposing reel flanges coupled to said reels defining a support surface for the winding of a hose;

a crank releasably insertable through one of said hubs providing a direct coupling to said spool assembly for manual rotation thereof;

a hose connector releasably insertable through one of said hubs providing an inlet connection fluidly communicating an inlet adapter on an outer side surface of said frame side to an outlet adapter on an inner side surface of said frame side; and a pair of wheels axially journaled to said frame sides juxtapositioned to each said outer side surface and extending beneath each said bottom wall.

17. The portable hose cart for windably holding an elongated flexible hose according to claim 16 wherein each said tubular support member is further defined as a coated steel tube.

18. The portable hose cart for windably holding an elongated flexible hose according to claim 17 wherein said coated steel tube is further defined as a seamless heated plastic sleeve secured to a steel tube.

19. The portable hose cart for windably holding an elongated flexible hose according to claim 16 including a hose guide with a hose guide support spaced apart from said spool assembly, said hose guide having a window for passage of a hose through said window with said hose guide being substantially freely movable along a horizontal path provided by said hose guide support whereby a hose can be wound on said spool assembly in layers with adjacent turns in each layer being contiguous and without the operator handling the hose by the operator simultaneously operating said crank for rotation of said spool assembly and moving said hose guide along the horizontal path.

20. The portable hose cart for windably holding an elongated flexible hose according to claim 19 wherein said hose guide includes a roller means providing each of hose passage.

21. The portable hose cart for windably holding an elongated flexible hose according to claim 16 including a storage box having an open end, said box securable to said upper support member.

* * * * *